United States Patent [19]

Roussin et al.

[11] Patent Number: 5,018,792

[45] Date of Patent: May 28, 1991

[54] IMPACT RIPPER APPARATUS WITH LINEAR RECIPROCATING RAM

[75] Inventors: Michael A. Roussin, Peoria; Charles M. Crowell, Jr., Trivoli, both of Ill.

[73] Assignee: Caterpillar Inc., Peoria, Ill.

[21] Appl. No.: 528,401

[22] Filed: May 25, 1990

[51] Int. Cl.[5] ..... B25D 17/00; E02F 3/32

[52] U.S. Cl. ..... 299/37; 37/DIG. 18; 173/162.1

[58] Field of Search ..... 299/37, 69; 37/DIG. 18; 173/138, 162.1, 40

[56] References Cited

U.S. PATENT DOCUMENTS

| | | | |
|---|---|---|---|
| 3,367,716 | 2/1968 | Bodine | 299/14 |
| 3,437,381 | 4/1969 | Bodine | 299/37 |
| 4,318,446 | 3/1982 | Livesay | 173/123 X |
| 4,336,848 | 6/1982 | Wanner | 173/139 |
| 4,724,912 | 2/1988 | Miyazaki et al. | 173/162.1 |

FOREIGN PATENT DOCUMENTS

| | | | |
|---|---|---|---|
| 1540070 | 2/1979 | United Kingdom | 37/DIG. 18 |

*Primary Examiner*—Ramon S. Britts
*Assistant Examiner*—David J. Bagnell
*Attorney, Agent, or Firm*—Calvin E. Glastetter

[57] ABSTRACT

Impact rippers are useful for transmitting high impact blows to a hard material for fracturing the material. When linear reciprocating rams are used, a mounting arrangement which will withstand high compressive forces and still allow the ram to reciprocate must be used to mount the ram within a tool holder. The subject impact ripper apparatus includes a tool holder having a cavity for mounting a linear ram. The linear ram is mounted within the cavity by a plurality of laminated pads which withstand compressive force, but still allows the ram to reciprocate. This arrangement which is stiff in compression, but relatively soft in shear.

11 Claims, 3 Drawing Sheets

IMPACT RIPPER APPARATUS WITH LINEAR RECIPROCATING RAM

DESCRIPTION

1. Technical Field

This invention relates to an impact ripper apparatus and more particularly to an arrangement for mounting a linear reciprocating ram within a tool holder.

2. Background Art

Impact rippers having reciprocating linear rams are commonly used to deliver high energy impact blows to material to be fractured, such as rock, coal, shale, cement, and so forth. One example of such use involves positioning a shank within a sleeve for supporting and guiding the shank. One of the problems associated with such an arrangement of the shank being supported by a sleeve is that friction could damage the relative parts. In another example, it has been proposed to resiliently position a shaft within a sleeve by means of a rubber bushing which is molded or vulcanized to both the shaft and the sleeve to form an integral unit, the sleeve being resiliently suspended from a frame structure by a pair of elastic pillars fabricated of a resilient material such as rubber. A problem associated with such an arrangement is that the rubber supporting the shaft within the sleeve and the elastic pillars will be easily deformed and damaged.

The present invention is directed to overcome one or more of the problems as set forth above.

DISCLOSURE OF THE INVENTION

An impact ripper apparatus includes a mounting frame adapted to be mounted on a vehicle. A tool holder having a first end portion is attached to the mounting frame. A second end portion projects downwardly from the mounting frame. The second end portion has a cavity therethrough. A linear ram is movably supported within the cavity. A plurality of laminated pads resiliently position the linear ram within the cavity relative to the tool holder. An impact hammer is arranged to deliver impact blows to the linear ram moving the linear ram and deforming the pads to allow delivery of impact blows to the material to be fractured.

The present invention provides an impact ripper apparatus having an improved support for mounting the linear ram within the cavity of the tool holder. Laminated pads are used to withstand high compressive forces, but still allow movement within the laminated construction. This laminated pads permit the linear ram to reciprocate without sliding with respect to the pads, thus reducing wear on the relatively movable parts.

BEST MODE FOR CARRYING OUT THE INVENTION

Figure 1:
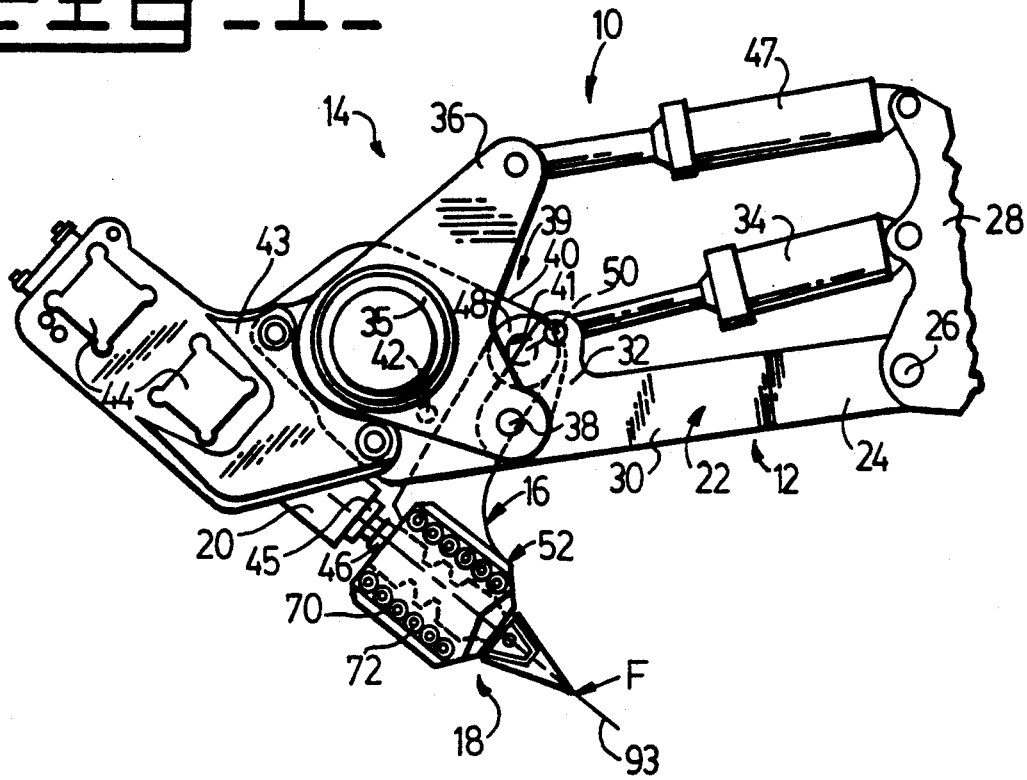
FIG. 1 is a side view of an impact ripper apparatus showing an embodiment of the present invention.
Figure 2:
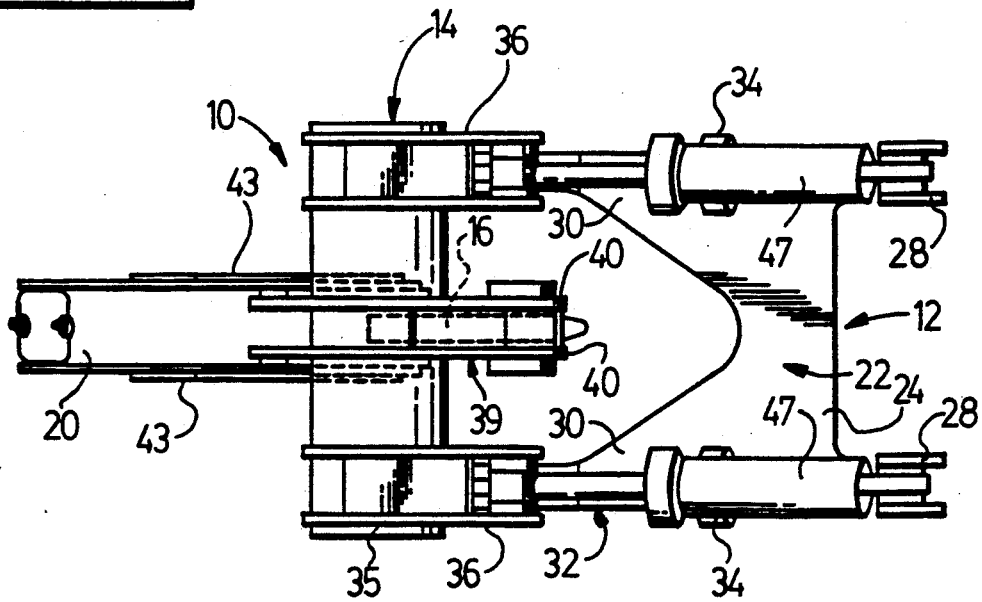
FIG. 2 is a plan view of an impact ripper apparatus showing the present invention.
Figure 3:
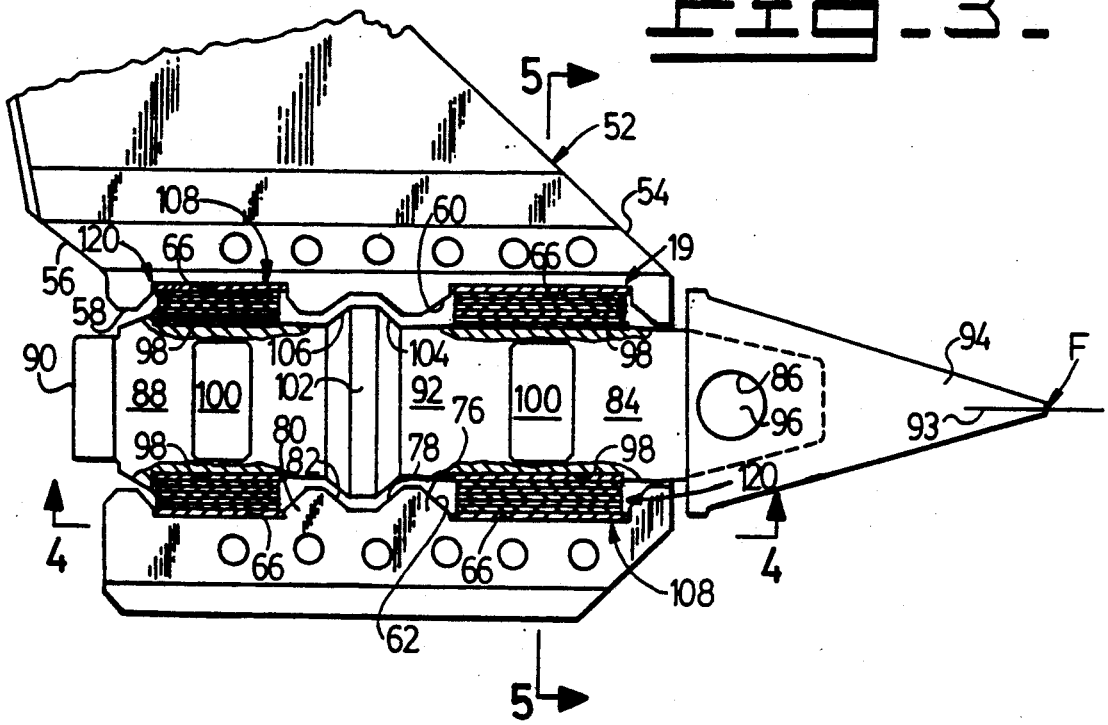
FIG. 3 is an enlarged side view of the tool holder of the present invention the cover is removed to more clearly show the internal parts.
Figure 4:
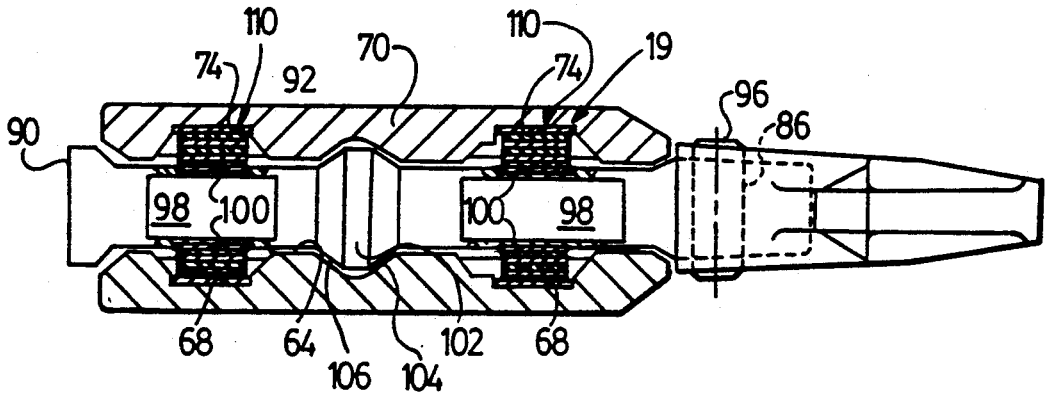
FIG. 4 is a sectional view of the tool holder taken along line 4—4 in FIG. 3 the cover is added to show the arrangement of the parts.
Figure 5:
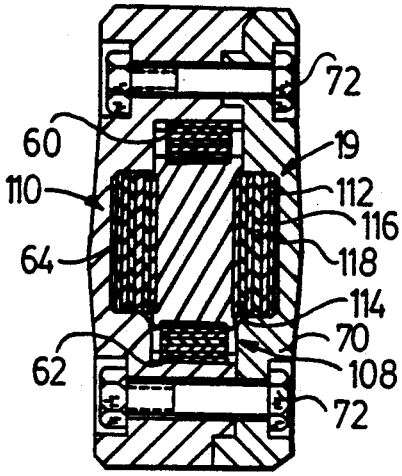
FIG. 5 is a sectional view of the tool holder taken along line 5—5 in FIG. 3 the has been added to show the arrangement of parts.

Referring to the drawings, a impact ripper apparatus 10 is shown in association with a support structure 12 and includes a mounting frame 14, a tool holder 16, a linear ram 18, a plurality of rectangular shaped laminated pads 19, and an impact hammer 20.

The support structure 12 includes a support frame 22. The support frame 22 has a first end portion 24 pivotally attached by a pair of pins 26 to a bracket 28 on a vehicle (not shown). The support frame 22 includes a pair of rearwardly projecting transversely spaced legs 30 defining a second end portion 32 of the support frame 22. A pair of hydraulic cylinders 34 extend between the bracket 28 and the second end portion 32 of the support frame 22 to elevationally position the support frame 22.

The mounting frame 14 includes a crossbeam 35 and a pair of end support structures 36 mounted on laterally spaced opposite ends of the crossbeam 35 and being pivotally attached by a pair of pins 38 to the second end portion 32 of the support frame 22. The mounting frame 14 further includes a first support structure 39 having spaced support plates 40. The spaced support plates 40 have a pair of aligned holes 41 and a stop 42 positioned between and welded to the spaced support plates 40. A pair of spaced apart second support plates 43 are mounted on the mounting frame 14, one on each side of the first support structure 39. The impact hammer 20 is mounted between the spaced second support plates 43 of the mounting frame 14 by a plurality of mounting assemblies 44. The impact hammer 20 includes a piston 45 having an impact surface 46. A pair of hydraulic cylinders 47 are positioned between each of the end support structures 36 and the bracket 28 to pivot the mounting frame 14 about the pins 38.

The tool holder 16 has a first end portion 48 pivotally attached between the spaced support plates 40 of the first support structure 39 by a pin 50 positioned within the aligned holes 41, and a second end portion 52 projecting downwardly from the mounting frame 14. The second end portion 52 has a material engaging front edge 54 and a rear edge 56. A cavity 58 in the tool holder 16 extends from the front edge 54 to the rear edge 56. The cavity 58 is defined by an upper surface 60, a lower surface 62, and a side surface 64. The upper and lower surfaces 60, 62 each has a pair of spaced rectangular mounting recesses, as shown by reference numeral 66. The upper and lower mounting recesses 66 each have the longest length thereof aligned with the length of the cavity 58. The side surface 64 has a pair of spaced rectangular mounting recesses, as shown by reference numeral 68. The mounting recesses 68 each have the longest length thereof transverse to the longest length of the mounting recesses 66. The tool holder 16 includes a cover assembly 70 removably attached to the second end portion 52 by a plurality of fastening means 72, such as bolts, to enclose the cavity 58. The cover assembly 70 has a pair of spaced rectangular mounting recesses 74, adjacent the cavity 58, having the longest length thereof aligned with the longest length of the mounting recesses 68 in the side surface 64 of the cavity 58. A first annular shoulder 76 forms a front stop surface 78. A second annular shoulder 80 forms a rear stop surface 82.

The linear ram 18 has a first end portion 84 having a hole 86 therethrough, a second end portion 88 having an impact surface 90, and an intermediate portion 92 positioned within the cavity 58. The linear ram 18 has a longitudinal axis 93. A material engaging tip 94 is removably attached to the first end portion 88 of the linear ram 18 by a pin 96 positioned within the hole 86 of the linear ram 18. The intermediate portion 92 has a pair of upper and a pair of lower rectangular mounting recesses, as shown by reference numeral 98. The recesses 98 each have the longest length thereof aligned with the length of the linear ram 18 and being positioned to align with the upper and lower recesses 66 of the tool holder 16. The intermediate portion further has a pair of rectangular mounting recesses on each side, as shown by reference numeral 100. The recesses 100 having the longest length thereof aligned with the longest length of the recesses 68 of the tool holder 16 and the recesses 74 of the cover assembly 70. The recesses 100 each have the longest length thereof transverse to the longest length of the recesses 98. A raised shoulder 102 on the intermediate portion 92 has a front stop surface 104 and a rear stop surface 106 which interacts with the front and rear stop surfaces 78, 82 within the cavity 58 to limit linear motion of the ram 18.

The plurality of laminated pads 19, in this embodiment the plurality includes eight pads, are used to resiliently position the linear ram 18 within the cavity 58 relative to the tool holder 16. The plurality of laminated pads 19 includes a first set of four pads 108 each having the longest length thereof aligned with the axis 93 of linear ram 18, and a second set of four laminated pads 110 having the longest length thereof transverse to the longest length of the first set of pads 108 and the axis 93 of the linear ram 18. Each of the pads 19 include a first plate 112, a second plate 114, and alternating layers of elastomeric rubber sheets 116 and noncompressable plates 118 bonded between the first and second plates 112, 114. In use, the first plate 112 is positioned within one of the recesses 66, 68 or 74 of the tool holder 16. The second plate 114 is positioned within the complimentary one of the recesses 98 or 100 of the linear ram 18 for movement with the linear ram 18. The elastomeric rubber sheets 116 of the plurality of pads 19 are in the hardness range of 70–80 shore durometer "A". The first set of pads 108 has a pair of pads 120 which counteract a force F on the material engaging tip 94 when the tip 94 is in contact with the material to be ripped. One pad of the pair 120 is positioned below the linear ram 18 adjacent the material engaging tip 94 and the other pad of the pair 120 is positioned above the linear ram 18 adjacent the second end portion 88 and is spaced from the material engaging tip 94. The pair of pads 120 are more heavily loaded than the remaining pads when force F is applied to the tip 94. Alternatively the pair of pads 120 could have an elastomeric rubber hardness of 75–90 Shore dorometer "A", which is greater than the rubber hardness of the remaining pads of the plurality of pads 19, to withstand the heavier load. Also the pair of pads 120 could have a greater number of the compressible and noncompressable plates than the remaining pads of the plurality of pads 19 to counteract the force F.

Figure 6:
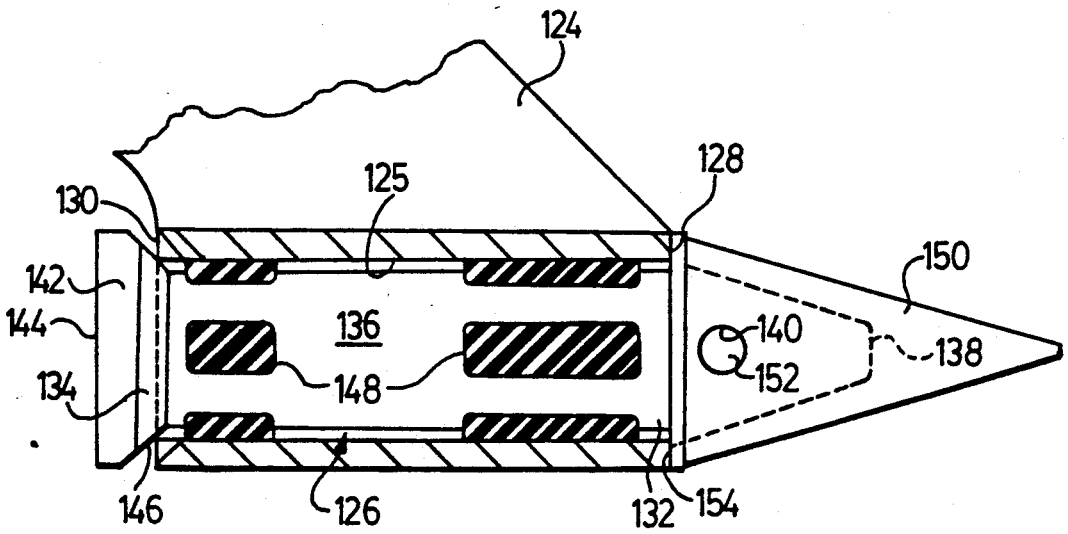
FIG. 6 is a sectional side view of the tool holder showing an alternate embodiment of the invention.

An alternate embodiment, as shown in FIG. 6, includes a tool holder 124 having a cavity 125 and a linear ram 126 positioned within the cavity 125. The tool holder 124 includes a front thrust surface 128 and a rear thrust surface 130. The linear ram 126 includes a first end portion 132, a second end portion 134, and an intermediate portion 136. The first end portion 132 includes a tapered portion 138 projecting beyond the tool holder 124 and having a hole 140 therethrough. The second end portion 134 includes an enlarged shoulder portion 142 having an impact surface 144 and a thrust surface 146 adjacent the thrust surface 130 of the tool holder 124. The intermediate portion 136 includes a plurality of laminated pads 148. A material engaging tip 150 is removably attached to the tapered portion 138 by a pin 152 positioned within the hole 140. The material engaging tip 150 includes a thrust surface 154.

INDUSTRIAL APPLICABILITY

In the use of the embodiment of FIG. 1, the linear ram 18 and the laminated pads 19 are shown in the relaxed or neutral position they would occupy when no force F is applied on the material engaging tip 94. With the linear ram 18 in the neutral position, the tool holder 16 is moved into the material to be ripped, thus a force F is applied to the material engaging tip 94 and linear ram 18. With the force F applied as shown, the pair of pads 120, one positioned below the linear ram 18 adjacent the tip 94 and the other positioned above the ram and spaced from the tip 94 are more heavily loaded than the remaining pads. The first set of pads 108 absorb the compressive loads of the force F on the tip 94 aligned with the linear ram 18. The second set of pads 110 absorb compressive side loads and resist twisting forces on the ram 18. The pads are stiff when a load is applied to compress the pads but still allow the ram 18 to move axially within the cavity 58 when a force F is applied to the tip 94 or when impacted by the impact hammer 20. Continued movement will increase the force F on the tip 94. The increased force F will overcome the resistance of the pads and move the linear ram 18 toward the piston 45 of the impact hammer 20. The alternating layers of rubber will deform and allow the linear ram 18 to move. The linear ram 18 will continue to move rearward until the rear thrust surface 106 of the linear ram 18 contacts the rear thrust surface 82 of the tool holder 16. With the thrust surfaces 82, 106 in contact, the tool holder 16 will pivot rearwardly around the pin 50 until the tool holder contacts the stop 42 on the first support structure 39.

With the tool holder 16 pivoted rearward, the impact hammer 20 is actuated to drive the piston 45 forward causing the impact surface 46 to impact the impact surface 90 of the linear ram 18. The impact will drive the linear ram 18 forward causing the tip 94 to deliver high impact energy into the material being ripped. This impacting will be repeated until the material fractures. When the material fractures, the linear ram 18 is allowed to move further forward with the pads going through the neutral position and deflecting in the opposite direction. The forward movement of the linear ram 18 will be stopped when the front thrust surface 104 of the linear ram contacts the front thrust surface 78 of the tool holder 16.

In view of the foregoing, it is readily apparent that the structure of the present invention provides a tool holder and linear ram mounting arrangement having laminated pads which will support the linear ram vertically and horizontally, but still allow the linear ram to move axially within the cavity of the tool holder.

Other aspects, objects, and advantages of this invention can be obtained from a study of the drawings, the disclosure and the appended claims.

We claim:

1. An impact ripper apparatus, comprising:

a mounting frame;

a tool holder having a first end portion attached to the mounting frame and a second end portion projecting downwardly from the mounting frame, the second end portion having a cavity therethrough;

a linear ram movably supported within the cavity and having a longitudinal axis;

a plurality of resilient laminated pads having alternating layers of elastomeric sheets and noncompressable plates resiliently positioning the linear ram within the cavity relative to the tool holder, the plurality of pads being spaced around the linear ram; and an impact hammer attached to the mounting frame and being arranged to deliver impact blows to the linear ram moving the linear ram which deforms the alternating layers of elastomeric sheets to allow delivery of impact blows to the material to be fractured.

2. The impact ripper apparatus of claim 1 wherein the plurality of laminated pads include a first set of rectangular pads having the longest length thereof aligned with the axis of linear ram and a second set of rectangular pads having the longest length thereof transverse to the longest length of the first set of pads and the axis of the linear ram.

3. The impact ripper apparatus of claim 2 wherein the first set of pads include a pair of pads having a elastomeric hardness greater than the elastomeric hardness of the remainder of the plurality of pads.

4. The impact ripper apparatus of claim 3 wherein the pair of pads have a greater number of noncompressable plates than the number of noncompressable plates of the remainder of the plurality of pads.

5. The impact ripper apparatus of claim 4 wherein one of the pair of pads is positioned below the linear ram adjacent a material engaging tip on the linear ram and the other one of the pair of pads is positioned above the linear ram and axially spaced from the material engaging tip.

6. The impact ripper apparatus of claim 5 wherein the elastomeric sheets of the pair of pads has a hardness range of 75–90 Shore durometer "A".

7. The impact ripper apparatus of claim 1 wherein the elastomeric sheets in the plurality of laminated pads are formed of an elastomer in the hardness range of 70–80 Shore durometer "A".

8. The impact ripper apparatus of claim 7 wherein the elastomeric sheets are formed of rubber.

9. The impact ripper apparatus of claim 8 wherein each of the pads in the plurality has a specified number of noncompressable plates.

10. The impact ripper apparatus of claim 9 wherein the specified number of noncompressable plates is in the range of 4–19.

11. The impact ripper apparatus of claim 10 wherein the plurality of pads equal eight.

* * * * *

UNITED STATES PATENT AND TRADEMARK OFFICE

CERTIFICATE OF CORRECTION

PATENT NO. : 5,018,792

DATED : May 28, 1991

INVENTOR(S) : Michael A. Roussin et al.

It is certified that error appears in the above-identified patent and that said Letters Patent is hereby corrected as shown below:

In the Abstract, line 11, after "arrangement" insert --provides for a resilient mounting arrangement--.

Signed and Sealed this

Twentieth Day of October, 1992

*Attest:*

DOUGLAS B. COMER

*Attesting Officer*

*Acting Commissioner of Patents and Trademarks*